US009221587B2

(12) United States Patent
Manahan

(10) Patent No.: US 9,221,587 B2
(45) **Date of Patent: *Dec. 29, 2015**

(54) ENCLOSURE CLAMPS AND CLAMP SYSTEMS

(71) Applicant: Cooper Technologies Company, Houston, TX (US)

(72) Inventor: Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 12 days.

This patent is subject to a terminal disclaimer.

(21) Appl. No.: 14/100,709

(22) Filed: Dec. 9, 2013

(65) Prior Publication Data

US 2014/0091583 A1 Apr. 3, 2014

Related U.S. Application Data

(63) Continuation of application No. 13/541,442, filed on Jul. 3, 2012, now Pat. No. 8,602,245, which is a continuation of application No. PCT/US2010/020066, filed on Jan. 5, 2010.

(51) Int. Cl.

| | |
|---|---|
| ***B65D 45/16*** | (2006.01) |
| ***B65D 45/02*** | (2006.01) |
| ***F42B 39/00*** | (2006.01) |

(52) U.S. Cl.

CPC ..... *B65D 45/02* (2013.01); *B65D 45/16* (2013.01); *F42B 39/00* (2013.01); *Y10T 292/20* (2015.04); *Y10T 292/218* (2015.04)

(58) Field of Classification Search

USPC ..... 220/325, 322, 324, 320, 315; 248/229.11, 229.14, 229.16, 228.7, 248/231.81, 226.11, 200, 228.5, 231.71, 248/227.2

See application file for complete search history.

(56) References Cited

U.S. PATENT DOCUMENTS

| | | | | |
|---|---|---|---|---|
| 1,018,041 | A * | 2/1912 | Evensen | 220/592.26 |
| 1,019,094 | A * | 3/1912 | Skahen | 292/257 |
| 1,382,501 | A | 6/1921 | Graham | |
| 1,450,687 | A | 4/1923 | Kunin | |
| 1,941,294 | A | 12/1933 | Eck et al. | |
| 2,361,186 | A | 10/1944 | Fishbein et al. | |
| 2,639,834 | A | 5/1953 | Medley | |
| 3,035,860 | A | 5/1962 | Bradner | |
| 3,754,674 | A | 8/1973 | Wesoloski | |
| 3,800,972 | A | 4/1974 | Raymond | |
| 3,974,933 | A | 8/1976 | Toth et al. | |

(Continued)

*Primary Examiner* — Terrell McKinnon
*Assistant Examiner* — Michael McDuffie
(74) *Attorney, Agent, or Firm* — King & Spalding LLP

(57) ABSTRACT

Enclosure clamps and clamp systems are provided for fastening a cover to an enclosure body to provide an explosion-proof container, while minimizing the number of bolts used over conventional systems. The enclosure clamps and clamp systems create a sufficient force so as to provide a flamepath between the cover and the enclosure body. The enclosure clamps described include a channel for receiving the cover and a flange on the enclosure body. The enclosure clamp is secured to the enclosure body by one or more bolts and/or by a cam actuated securing mechanism. The clamp systems described include a force distributing plate secured to a cover by cam actuated securing mechanism that is coupled to an enclosure body. The enclosure clamps and clamp systems allow a user to attach or remove the cover from the enclosure body more easily than possible with conventional explosion-proof enclosures.

20 Claims, 4 Drawing Sheets

(56) References Cited

U.S. PATENT DOCUMENTS

| | | | | |
|---|---|---|---|---|
| 4,158,423 | A | 6/1979 | Starr | |
| 4,331,257 | A | 5/1982 | Taschner | |
| 4,570,816 | A | 2/1986 | Ferris et al. | |
| 4,656,793 | A | 4/1987 | Fons | |
| 4,664,281 | A | 5/1987 | Falk et al. | |
| 5,004,129 | A | 4/1991 | Loch et al. | |
| 5,368,182 | A | 11/1994 | Schutz | |
| 5,501,357 | A | 3/1996 | Fullin | |
| 5,657,892 | A | 8/1997 | Bolli et al. | |
| 6,753,473 | B2 | 6/2004 | Barlian et al. | |
| 7,159,832 | B2 | 1/2007 | Easterling | |
| 7,195,131 | B2 | 3/2007 | Bryant | |
| 7,386,922 | B1 | 6/2008 | Taylor et al. | |
| 7,631,780 | B2 | 12/2009 | Plattner | |
| 8,485,382 | B2 | 7/2013 | Raghunathan et al. | |
| 2004/0065666 | A1 | 4/2004 | Walker | |
| 2004/0118850 | A1 | 6/2004 | Kim | |
| 2006/0138144 | A1 | 6/2006 | Montminy | |
| 2008/0251515 | A1 | 10/2008 | Baughman | |
| 2009/0223965 | A1 | 9/2009 | Raghunathan et al. | |
| 2010/0193520 | A1 | 8/2010 | Nagy et al. | |
| 2011/0127264 | A1 | 6/2011 | Whalen | |
| 2012/0043328 | A1 | 2/2012 | Pirner | |
| 2012/0211493 | A1* | 8/2012 | Daggett | 220/315 |
| 2013/0032597 | A1 | 2/2013 | Anderson | |
| 2013/0098921 | A1* | 4/2013 | Yang et al. | 220/573.1 |

* cited by examiner

ENCLOSURE CLAMPS AND CLAMP SYSTEMS

RELATED APPLICATION

This application is a continuation application of and claims priority to U.S. patent application Ser. No. 13/541,442, entitled "Enclosure Clamps and Clamp Systems" and filed on Jul. 3, 2012, which is itself a continuation application of International Application Number PCT/US2010/020066, entitled "Enclosure Clamps And Clamp Systems," filed Jan. 5, 2010, both of which are incorporated herein by reference in their entirety.

TECHNICAL FIELD

The present invention relates generally to enclosure clamps and clamp systems for securing a cover to an enclosure body used in hazardous areas.

BACKGROUND OF THE INVENTION

Explosion-proof enclosures may be used to enclose critical equipment in a hazardous environment. Explosion-proof enclosures typically include an enclosure body and a cover that prevents access to the interior when the cover is coupled thereto, and allows access to the interior upon removal of the cover. Conventionally, the cover is secured to the enclosure body using numerous bolts. Under some circumstances, as many as 64 bolts are used to secure the cover to the enclosure body. The coupling and uncoupling of numerous bolts is generally time-consuming and tedious for the user when trying to remove or secure the cover to the enclosure body.

Accordingly, a need exists in the art for providing a device that allows a user to attach or remove a cover from an enclosure body more easily than possible with conventional explosion-proof enclosures.

SUMMARY OF THE INVENTION

The present invention attempts to satisfy the above-described need by providing enclosure clamps and clamp systems for securing a cover to an enclosure body. Generally, the enclosure clamps and clamp systems can provide a sufficient force to create a gap, or flamepath, between the cover and the enclosure body to allow the system to withstand an explosion.

In a first embodiment, an enclosure clamp can secure an enclosure body to a cover. In certain aspects, the enclosure clamp includes a center portion, a flange extending orthogonally from one end of the center portion, and an upper portion extends at an angle away from the first flange. The center portion, the flange, and the upper portion define a channel configured to accommodate a flange and an edge of a cover of an explosion-proof container. In certain aspects, the enclosure clamp includes one or more apertures configured to receive a fastener, such as a bolt. In certain aspects, another flange extends from the upper portion, with the flange being positioned parallel to the flange extending from the center portion. In certain aspects, the flange is configured to engage a securing arm.

In another embodiment, an enclosure clamp system includes an enclosure clamp securing a cover to an enclosure body to provide an explosion-proof enclosure. In certain aspects, the enclosure clamp includes a center portion, a flange extending orthogonally from one end of the center portion, and an upper portion extends at an angle away from the first flange. The center portion, the flange, and the upper portion define a channel that receives a portion of the cover and the enclosure body. In certain aspects, the enclosure clamp is secured to the enclosure body by one or more bolts extending through apertures in the center portion of the enclosure clamp and apertures in the enclosure body. In certain aspects, another flange extends from the upper portion, with the flange being positioned parallel to the flange extending from the center portion. In certain aspects, the enclosure clamp systems include a securing arm that is coupled to the cover. The securing arm is movable by cam actuation, and is configured to engage the flange extending from the upper portion when in the locked position. In certain aspects, enclosure clamp is coupled to a pivot arm or slidable arm that is fixed to the cover or the enclosure body. In certain aspects, the cover is hingedly coupled to the enclosure body.

In yet another embodiment, an enclosure securing system includes a clamp system securing an enclosure body to a cover. The clamp system includes a force distributing plate positioned along a side of the cover opposite the enclosure body, and a securing arm movably coupled to the enclosure body. In certain aspects, the securing arm is movable between a locked and unlocked position by cam actuation. The securing arm applies a force against the force distributing plate when in a locked position so as to provide an explosion-proof container.

These and other aspects, objects, features and embodiments of the present invention will become apparent to those skilled in the art upon consideration of the following detailed description of illustrated embodiments exemplifying the best mode for carrying out the invention as presently perceived.

DETAILED DESCRIPTION OF THE INVENTION

Figure 1:
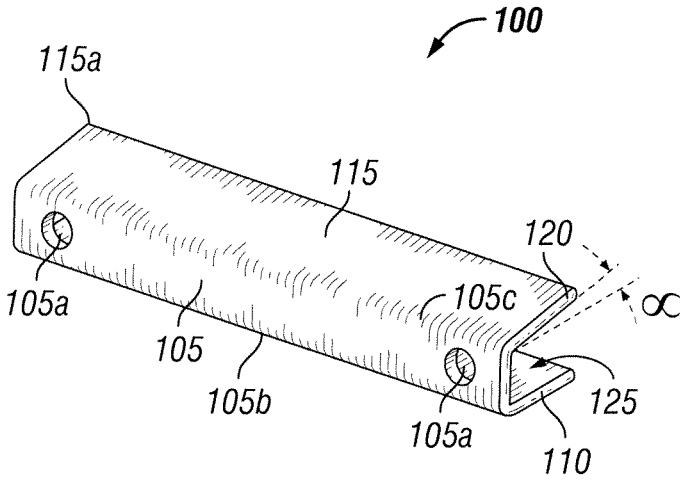
FIG. 1 is a perspective view of an enclosure clamp, according to an exemplary embodiment.

The present invention relates to enclosure clamps and clamp systems for securing a cover to an enclosure body to provide an explosion-proof enclosure. The enclosure clamps and clamp systems described herein allow users to more quickly and easily secure and/or remove the cover from the enclosure body over conventional securing mechanisms.

The invention may be better understood by reading the following description of non-limitative, exemplary embodiments with reference to the attached drawings wherein like parts of each of the figures are identified by the same reference characters.

FIG. 1 is a perspective view of an enclosure clamp 100, according to an exemplary embodiment. The enclosure clamp 100 can be used to secure a cover 230 (FIGS. 2A-2B) to an enclosure body 240 (FIGS. 2A-2B) to provide an explosion-proof enclosure. The enclosure clamp 100 includes a rectangular center portion 105 having two apertures 105*a* therein. Each of the apertures 105*a* is configured for receiving a fastener, such as a bolt 255 (FIGS. 2A-2B), for securing the enclosure clamp 100 to the enclosure body 240. One having ordinary skill in the art will recognize that the apertures 105*a* may be situated at any position along the length of the center portion 105. In certain alternative embodiments, only one aperture 105*a* may be present and located in the center of the center portion 105. In other embodiments, three apertures 105*a* may be present. One having ordinary skill in the art will recognize that multiple apertures 105*a* can be present on the center portion 105 and the configuration of these apertures 105*a* can vary.

Figure 2A:
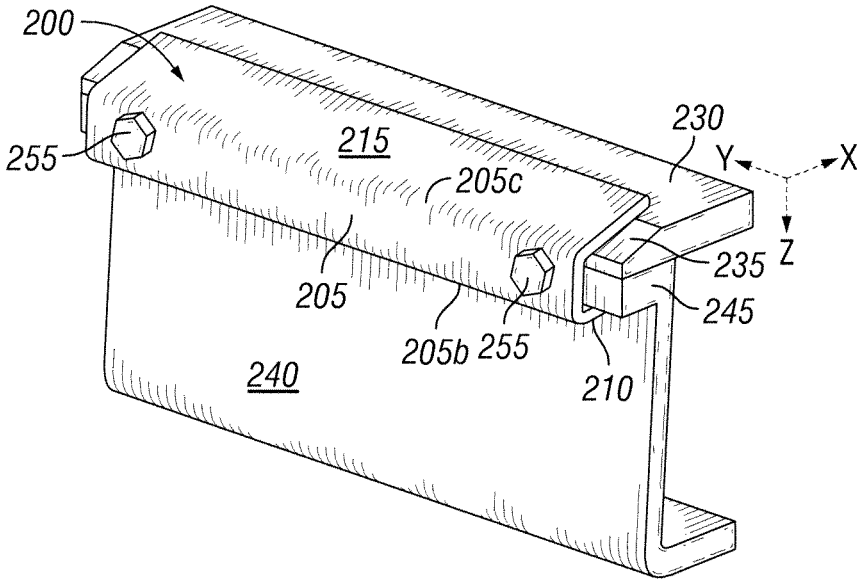
FIG. 2A is a perspective view of an enclosure clamp securing a cover to an enclosure body, according to an exemplary embodiment.
Figure 2B:
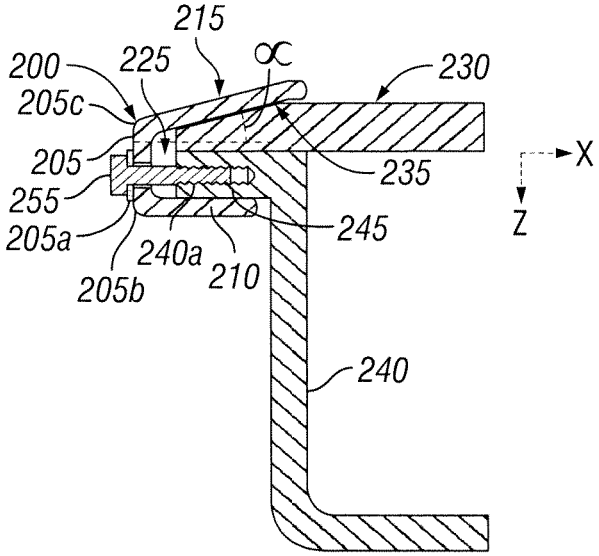
FIG. 2B is side cross-sectional view of the enclosure clamp securing the cover to the enclosure body shown in FIG. 2A, according to an exemplary embodiment.

The enclosure clamp 100 includes a rectangular lower portion 110 extending orthogonally from a lower end 105*b* of the center portion 105. The enclosure clamp 100 also includes a rectangular upper portion 115 extending from an upper end 105*c* of the center portion 105. The center portion 105, the lower portion 110, and the upper portion 115 define a channel 125 configured to received a portion of the cover 230 and a flange 245 of the enclosure body 240 (FIGS. 2A-2B). In certain embodiments, a rectangular flange 120 extends from an end 115*a* of the upper portion 115, and is parallel to the rectangular lower portion 110. In certain alternative embodiments, the flange 120 is absent.

The upper portion 115 extends at an angle α from a plane orthogonal to the center portion 105, in a direction away from the lower portion 110. In certain exemplary embodiments, the upper portion 115 extends at an angle α of about 15 degrees. In certain embodiments, the upper portion 115 extends at an angle α in a range from about 15 to 30 degrees. In certain embodiments, the upper portion 115 extends at an angle α so as to provide a sufficient amount of force on the cover 230 for clamping integrity. The upper portion 115 extends at an angle α sufficient to translate a bolt force from bolts 225 into a downward force on the cover 230 towards the enclosure body 240.

In certain exemplary embodiments, the enclosure clamp 100 is fabricated from extruded aluminum. In alternative embodiments, the enclosure clamp 100 is fabricated from die cast aluminum, stainless steel, and/or extruded steels.

FIGS. 2A and 2B are perspective and side cross-sectional views of an enclosure clamp 200 securing a cover 230 to an enclosure body 240, according to an exemplary embodiment. The enclosure clamp 200 is similar to the enclosure clamp 100, and includes a rectangular center portion 205, a rectangular lower portion 210 extending orthogonally from a lower end 205*b* of the center portion 205, and a rectangular upper portion 215 extending from an upper end 205*c* of the center portion 205 at an angle α from a plane orthogonal to the center portion 205. The center portion 205, the lower portion 210, and the upper portion 215 define a channel 225 that receives an angled portion 235 of the cover 230 and a flange 245 of the enclosure body 240. The portion 235 of the cover 230 positioned within the channel 225 is angled to correspond to the angle α of the upper portion 215 extending from the center portion 205. The upper portion 215 extends at an angle α sufficient to translate a bolt force from bolts 225 into a downward force on the cover 230 towards the enclosure body 240.

In certain exemplary embodiments, the upper portion 215 extends along the entire angled portion 235 of the cover 230. In alternative embodiments, the upper portion 215 extends along a portion of the angled portion 235 of the cover 230. The bolts 225 generate the same amount of downward force on the cover 230, however, the shape of the enclosure clamp 200 influences the distribution of those forces.

The flange 245 of the enclosure body 240 includes two cylindrical apertures 240*a* aligned with two apertures 205*a* present on the center portion 205. Triple lead bolts 255 are positioned within each of the apertures 205*a*, 240*a*, and secure the enclosure clamp 200 to the enclosure body 240. As the bolts 255 are tightened, the upper portion 215 translates the bolt force into a downward force, or clamping force, on the angled portion 235 of the cover 230. The downward force is such that a maximum gap (not shown), or flamepath, of about 0.0015 inch (in) is maintained between the cover 230 and the enclosure body 240, while the explosion-proof enclosure system is also able to sustain high pressures. In certain embodiments, the explosion-proof enclosure system is able to sustain pressures up to 560 pounds per square inch (psi). In certain embodiments, the explosion-proof enclosure system is able to sustain a pressure equal to four times the maximum combustion pressure. In certain embodiments, the diameter of the apertures 205*a*, 240*a*, and the bolts 225 can be varied to adjust the bolt force on the system. In certain embodiments, increasing the diameter of the bolts 225 may increase the bolt force on the system.

In certain embodiments, the enclosure clamp 200 has length that is substantially equal to a side of the cover 230 and the enclosure body 240. In other embodiments, the length of the enclosure clamp 200 is less than the length of a side of the cover 230 and the enclosure body 240. One having ordinary skill in the art will recognize that the enclosure clamp 200 can have any length, so long as the enclosure clamp 200 is able to maintain an appropriate flamepath between the cover 230 and the enclosure body 240, and sustain high pressures associated with an explosion.

In certain embodiments, guide studs (not shown) may be included to locate the cover 230 to the enclosure body 240. The guide studs are generally positioned in opposing corners of the enclosure body 240, and help locate the cover 230 to the enclosure body 240. The guide studs allow a user to easily clamp one side of the enclosure body 240 to the cover 230 without having to manually hold the cover 230 against the enclosure body 240. The guide studs aid in preventing movement in the X or Y direction, such that the entire clamping force is translated in the Z direction.

Figure 3:
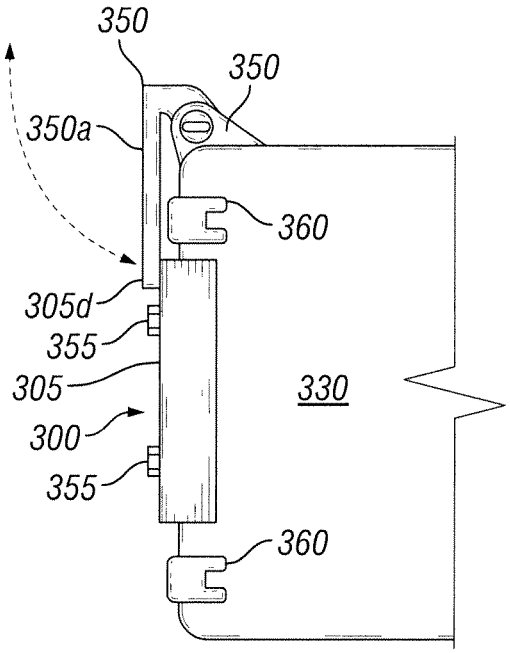
FIG. 3 is a top view of an enclosure clamp securing a cover to an enclosure body, according to another exemplary embodiment.

FIG. 3 is a top view of an enclosure clamp 300 securing a cover 330 to an enclosure body (not shown), according to another exemplary embodiment. The enclosure clamp 300 is similar to the enclosure clamp 200. The enclosure clamp 300 secures the cover 330 to the enclosure body using bolts 355, similar to the way the enclosure clamp 200 secures the cover 230 to the enclosure body 240 using bolts 255.

In certain exemplary embodiments, a pivot arm 350 having a substantially L-shaped portion 350*a* and a curved base 350*b* configured to attach to the enclosure body is included. The L-shaped portion 350*a* of the pivot arm 350 is coupled to a side 305*d* of a center portion 305 of the enclosure clamp 300. The base 350*b* of the pivot arm 350 is coupled to the enclosure body, and includes a pivot point 350*c* about which the L-shaped portion 350*a* of the pivot arm 350 pivots. In certain alternative embodiments, the pivot arm 350 is coupled to the cover 330, instead of the enclosure body. Since the pivot arm 350 is directly attached to the enclosure clamp 300 and the cover 330 or enclosure body 340, a user can easily secure and/or remove the enclosure clamp 300 while eliminating accidental misplacement of the enclosure clamp 300.

To secure the cover 330 to the enclosure body, the enclosure clamp 300 that is coupled to the pivot arm 350 is rotated in a counterclockwise direction about pivot point 350*c*. A channel (not shown) in the enclosure clamp 300 can receive the side of the cover 330 and the enclosure body. Bolts 355 are tightened to secure the enclosure clamp 300 to the enclosure body. To remove the cover 330 from the enclosure body, the bolts 355 are loosened and removed from the enclosure body, and the enclosure clamp 300 is separated from the cover 330 and the enclosure body by rotating the L-shaped portion 350*a* of the pivot arm 350 about pivot point 350*c* in a clockwise direction. The cover 330 can then be removed from the enclosure body.

In certain exemplary embodiments, two hinges 360 may be included for hingedly coupling the cover 330 to the enclosure body. Upon removal of the enclosure clamp 300, the cover 330 can be rotated about the hinges 360 to an open position to allow access to the interior of the enclosure body. In certain embodiments, the hinges 360 are positioned on the same side as the enclosure clamp 300. One having ordinary skill in the art will recognize that the hinges 360 can be positioned on any side of the enclosure. The presence of the hinges 360 can help prevent accidental misplacement of the cover 330 after removal.

Figure 4A:
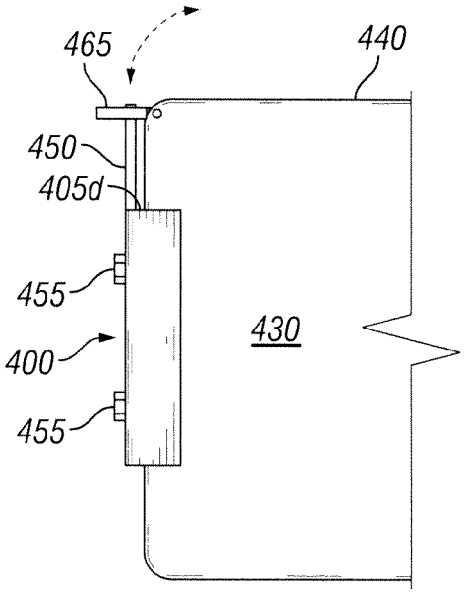
FIG. 4A is a top view of an enclosure clamp securing a cover to an enclosure body, according to yet another exemplary embodiment.
Figure 4B:
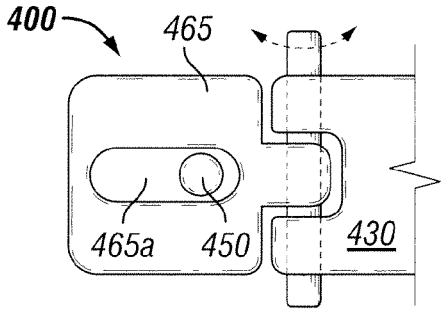
FIG. 4B is a side view of the enclosure clamp securing the cover to the enclosure body shown in FIG. 4A, according to an exemplary embodiment.

FIGS. 4A and 4B are top and side views of an enclosure clamp 400 securing a cover 430 to an enclosure body 440, according to another exemplary embodiment. The enclosure clamp 400 is similar to the enclosure clamp 300. The enclosure clamp 400 secures the cover 430 to the enclosure body 440 using bolts 455, similar to the way the enclosure clamp 300 secures the cover 330 to the enclosure body using bolts 355.

In certain exemplary embodiments, a slidable arm 450 is fixedly coupled to a side 405*d* of a center portion 405 of the enclosure clamp 400. The slidable arm 450 is slidably positioned within a slot 465*a* of a hinge 465. The hinge 465 is hingedly coupled to the cover 430. In alternative embodiments, the hinge 465 is hingedly coupled to the enclosure body 440, or to both the cover 430 and the enclosure body 440. To secure the cover 430 to the enclosure body 440, the enclosure clamp 400 is rotated in a counterclockwise direction via the hinge 465, such that the enclosure clamp 400 is aligned with a side of the cover 430 and the enclosure body 440. The slidable arm 450 is shifted within the slot 465*a* and towards the enclosure body 440 such that the cover 430 and the enclosure body 440 are received within a channel (not shown) in the enclosure clamp 400. The bolts 455 are tightened to secure the enclosure clamp 400 to the enclosure body 440.

To remove the cover 430 from the enclosure body 440, the bolts 455 are loosened and removed from the enclosure body 440, and the enclosure clamp 400 is separated from the cover 430 and the enclosure body 440 by sliding the slidable arm 450 away from the enclosure body 440 and rotating the slidable arm 450 about the hinge 465 in a clockwise direction. The cover 430 can then be removed from the enclosure body 440.

Figure 5:
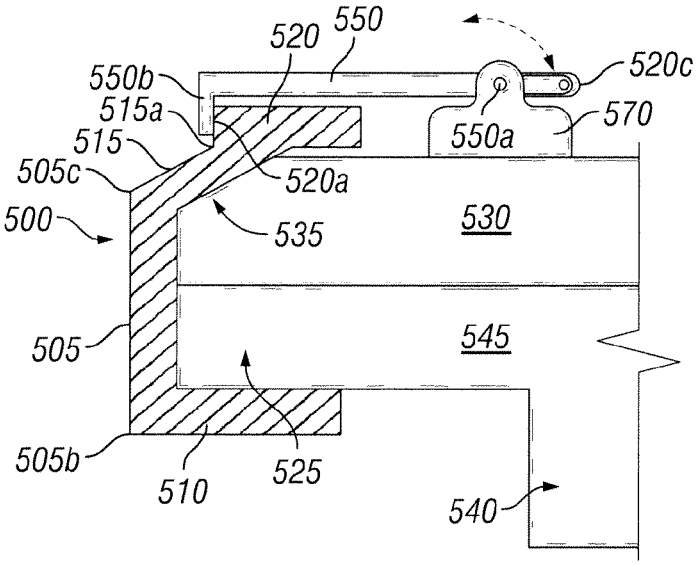
FIG. 5 is a side view of an enclosure clamp securing a cover to an enclosure body, according to yet another exemplary embodiment.

FIG. 5 is a side view of an enclosure clamp 500 securing a cover 530 to an enclosure body 540, without the use of any tools, according to another exemplary embodiment. The enclosure clamp 500 includes a rectangular center portion 505. A rectangular lower portion 510 extends orthogonally from a lower end 505*b* of the center portion 505. An upper portion 515 extends from an upper end 505*c* of the center portion 505, at an angle away from the lower portion 510. The center portion 505, the lower portion 510, and the upper portion 515 define a channel 525 that receives an angled portion 535 of the cover 530 and a flange 545 of the enclosure body 540. In certain embodiments, the upper portion 515 extends across a distance greater than the angled portion 535 of the cover 530. In alternative embodiments, the upper portion 515 extends across a distance less than or equal to the angled portion 535 of the cover 530.

In certain exemplary embodiments, a rectangular-shaped clip portion 520 extends from an end 515*a* of the upper portion 515. The clip portion 520 is parallel to the lower portion 510. The clip portion 520 is configured to engage a securing arm 550 that secures and locks the enclosure clamp 500 in place. In certain alternative embodiments, the clip portion 520 includes a groove (not shown) configured to receive a corresponding portion of the securing arm 550. One having ordinary skill in the art will recognize that the clip portion 520 can be configured any number of ways, so as to engage and secure the securing arm 550 to the enclosure clamp 500.

The force exerted by the securing arm 550 on the clip portion 520 is translated into a clamping force against the cover 530 towards the enclosure body 540. The clamping force is such that a maximum gap of about 0.0015 in. is maintained between the cover 530 and the enclosure body 540, and the system is able to sustain exposure to high pressures.

The securing arm 550 is coupled to an actuation base 570 that is fixed to the cover 530. The securing arm 550 is movable about a pivot point 550*a* by cam actuation. One having ordinary skill in the art will recognize that the securing arm 550 can be movable about pivot point 550*a* in any number of ways. The securing arm 550 includes a latching flange 550*b* that engages a side 520*a* of the clip portion 520 and locks the enclosure clamp 500 in place. To remove the enclosure clamp 500, an end 550*c* of the securing arm 550 is shifted in a counterclockwise direction, thus allowing the securing arm 550 to move about the pivot point 550*a* by cam actuation. The latching flange 550*b* disengages the side 520*a* of the clip portion 520 and the securing arm 550 can be rotated in the clockwise direction to release the latching flange 550*b* from the enclosure clamp 500. The enclosure clamp 500 can then be removed.

Figure 6A:
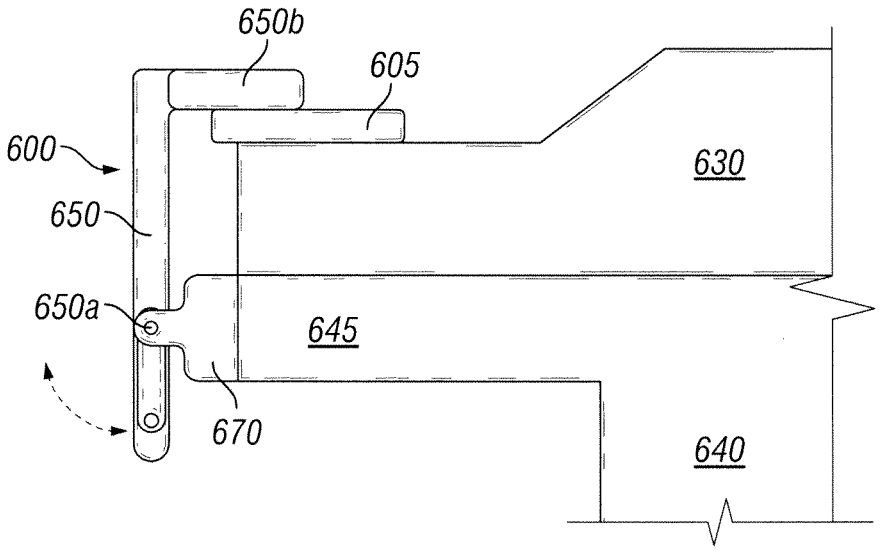
FIG. 6A is a side view of a clamp system securing a cover to an enclosure body, according to an exemplary embodiment.
Figure 6B:
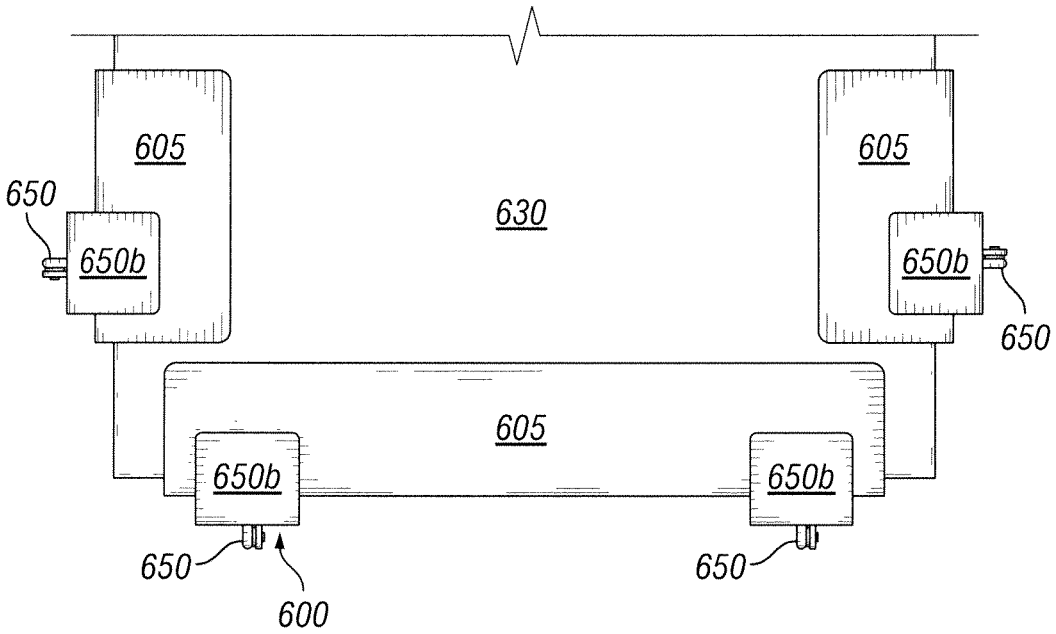
FIG. 6B is a top view of the clamp system securing the cover to the enclosure body shown in FIG. 6A, according to an exemplary embodiment.

FIGS. 6A and 6B are side and top views of a clamp system 600 securing a cover 630 to an enclosure body 640, without the use of any tools, according to an exemplary embodiment. The clamp system 600 includes a rectangular force distributing plate 605 and two securing arms 650 on each side of the enclosure body 640. Each securing arm 650 is coupled to an actuation base 670. The actuation bases 670 are coupled to a flange 645 of the enclosure body 640. The securing arms 650 are similar to securing arm 550, and each include a latching flange 650*b* extending orthogonally therefrom. The actuation bases 670 are similar to the actuation base 570. In certain exemplary embodiments, a force distributing plate 605 is positioned along a length of each side of the cover 630. Each of the latching flanges 650*b* engages the force distributing plate 605 and applies a force on the cover 630 towards the enclosure body 640 to lock the cover 630 in place. The force exerted by the latching flanges 650*b* on the force distributing plate 605 is such that a maximum gap of about 0.0015 in. is maintained between the cover 630 and the enclosure body 640, and the system is able to sustain exposure to high pressures.

To remove the cover 630 from the enclosure body 640, an end 650*c* of the securing arm 650 is shifted in a clockwise direction, thus allowing the securing arm 650 to move about a pivot point 650*a* by cam actuation. The latching flange 650*b* disengages the force distributing plate 605 and the securing arm 650 can be rotated in the counterclockwise direction to release the clamp system 600 from the cover 630 and the enclosure body 640. The cover 630 can then be removed.

Generally, the enclosure clamps and clamp systems of the present invention may be fabricated from any material suitable for high strength and wear resistance. Suitable materials include, but are not limited to, steel. The enclosure clamps and clamp systems of the present invention are capable of supplying a uniform force so as to provide an appropriate gap, or flamepath, between the cover and the enclosure body. The gap is configured to allow a flame to pass through, while the system is able to withstand any pressures associated with an internal explosion. In certain exemplary embodiments, the gap is about 0.0015 in. and the system can withstand a hydrostatic pressure of about 560 pounds per square inch (psi).

To facilitate a better understanding of the present invention, the following example of certain aspects of some embodiments are given. In no way should the following example be read to limit, or define, the scope of the invention.

EXAMPLE

A cover was secured to an EJB121208 enclosure body (commercially available from Cooper Technologies Company) using the enclosure clamp shown in FIGS. 1 and 2A-2B. The enclosure body was constructed of sand cast aluminum alloy approaching grade 535 and the cover was constructed of plate aluminum (6061-T6). An enclosure clamp is secured to each side of the cover and enclosure body as described with respect to FIGS. 2A-2B. Each enclosure clamp includes two bolts, for a total of eight bolts on the system.

The system was subjected to a hydrostatic pressure test, as outlined in UL1203, section 22, dated Apr. 30, 2004. Water was pumped into the system by a Hydro Pump, model TD120, commercially available from Union, via a one inch pipe. A pressure gauge, model 1082-8-3, commercially available from Ashcroft, was positioned within the system. The system was subjected to hydrostatic pressure until failure. The system was able to withstand pressures of up to about 400 psi. At a pressure of about 400 psi, the enclosure clamps experienced permanent deformation and created a loss of seal, indicating that the system is able to withstand a normal explosions pressure, which is typically about 140 psi.

Therefore, the invention is well adapted to attain the ends and advantages mentioned as well as those that are inherent therein. Any spatial references herein, such as, for example, "top," "bottom," "upper," "lower," "above", "below," "rear," "between," "vertical," "angular," "beneath," etc., are for purpose of illustration only and do not limit the specific orientation or location of the described structure. The particular embodiments disclosed above are illustrative only, as the invention may be modified and practiced in different but equivalent manners apparent to those having ordinary skill in the art and having the benefit of the teachings herein. For instance, the number of bolts used may be reduced, or eliminated entirely, from certain enclosure clamps and clamp systems. Also, the clamping force of the enclosure clamps and clamp systems may be varied to provide a maximum gap, or flamepath, based on UL standards. In addition, mechanical variations, such as with respect to the cam latches, for applying the required force to the cover are within the purview of one having ordinary skill in the art. Furthermore, ribbing may be added to the clamps systems to prevent clamps from opening up. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention as defined by the claims below. The terms in the claims have their plain, ordinary meaning unless otherwise explicitly and clearly defined by the patentee.

What is claimed is:

1. An enclosure clamp system, comprising:

an explosion-proof enclosure comprising an enclosure body and a cover; and an enclosure clamp comprising:

a plurality of portions, wherein each portion of the plurality of portions is adjacent to at least one other portion of the plurality of portions; and one or more first apertures traversing through at least one portion of the plurality of portions, wherein the plurality of portions of the enclosure clamp defines a channel, wherein the enclosure body and the cover are at least partially positioned within the channel, wherein each of the one or more first apertures receives a fastener for securing to the explosion-proof enclosure, wherein the enclosure body comprises one or more second apertures, wherein the one or more second apertures are aligned with the one or more first apertures when the enclosure body and cover are positioned in the channel of the enclosure clamp.

2. The enclosure clamp system of claim 1, further comprising one or more bolts extending through the one or more first and the one or more second apertures.

3. The enclosure clamp system of claim 1, wherein the plurality of portions comprises a center portion, a lower portion extending from a first end of the center portion at a first angle relative to the center portion, and an upper portion extending from a second end of the center portion at a second angle relative to the center portion, wherein the second end is opposite the first end of the center portion.

4. The enclosure clamp system of claim 3, wherein the plurality of portions further comprises a second flange extending from the upper portion, wherein the second flange is substantially parallel to the lower portion.

5. The enclosure clamp system of claim 3, wherein the enclosure body comprises a body flange, wherein the body flange is substantially parallel to the lower portion when the enclosure body and the cover are positioned in the channel of the enclosure clamp, and wherein the cover is substantially parallel to the upper portion when the enclosure body and the cover are positioned in the channel of the enclosure clamp.

6. The enclosure clamp system of claim 5, wherein the cover comprises a first angled portion along its top surface that extends from an end of the cover at the second angle, wherein the first angled portion is substantially parallel to the upper portion when the enclosure body and the cover are positioned in the channel of the enclosure clamp.

7. The enclosure clamp system of claim 6, wherein the one or more first apertures are disposed in the upper portion of the enclosure clamp, and wherein the one or more second apertures are disposed in the angled portion of the cover.

8. The enclosure clamp system of claim 7, wherein the one or more first apertures are further disposed in the lower portion, and wherein the one or more second apertures are further disposed in the enclosure body.

9. The enclosure clamp system of claim 7, wherein the one or more first apertures are further disposed in the center portion, and wherein the one or more second apertures are further disposed in the enclosure body.

10. The enclosure clamp system of claim 7, wherein the body flange comprises a second angled portion along its bottom surface that extends from an end of the body flange at the first angle, wherein the second angled portion is substantially parallel to the lower portion when the enclosure body and the cover are positioned in the channel of the enclosure clamp.

11. The enclosure clamp system of claim 10, wherein the one or more first apertures are further disposed in the lower portion, and wherein the one or more second apertures are further disposed in the second angled portion of the enclosure body.

12. The enclosure clamp system of claim 5, wherein the body flange comprises an angled portion along its bottom surface that extends from an end of the body flange at the first angle, wherein the angled portion is substantially parallel to the lower portion when the enclosure body and the cover are positioned in the channel of the enclosure clamp.

13. The enclosure clamp system of claim 12, wherein the one or more first apertures are disposed in the lower portion of the enclosure clamp, and wherein the one or more second apertures are disposed in the angled portion of the body flange.

14. The enclosure clamp system of claim 13, wherein the one or more first apertures are further disposed in the upper portion, and wherein the one or more second apertures are further disposed in the cover.

15. The enclosure clamp system of claim 13, wherein the one or more first apertures are further disposed in the center portion, and wherein the one or more second apertures are further disposed in the cover.

16. The enclosure clamp system of claim 1, wherein the enclosure clamp, when mechanically coupled to the explosion-proof enclosure, maintains a flamepath between the enclosure body and the cover of approximately 0.0015 inches.

17. The enclosure clamp system of claim 1, wherein the enclosure clamp, when mechanically coupled to the explosion-proof enclosure, can withstand a pressure of approximately 560 pounds per square inch built up within the explosion-proof enclosure.

18. The enclosure clamp system of claim 1, wherein the enclosure clamp, when mechanically coupled to the explosion-proof enclosure, can sustain a pressure of approximately four times a maximum combustion pressure.

19. The enclosure clamp system of claim 1, wherein the fastener is a bolt, wherein the bolt has a diameter that is proportional to a bolt force applied through the enclosure clamp on the explosion-proof enclosure.

20. An enclosure clamp, comprising:

a plurality of portions, wherein each portion of the plurality of portions is adjacent to at least one other portion of the plurality of portions; and one or more apertures traversing through at least one portion of the plurality of portions, wherein the plurality of portions defines a channel, wherein the channel is configured to receive at least a portion of an enclosure body and a cover of an explosion-proof enclosure, wherein the explosion-proof enclosure encloses equipment and is located in a hazardous environment, wherein each of the one or more first apertures is configured to receive a fastener for securing to one or more second apertures in the explosion-proof enclosure, wherein the one or more first apertures are configured to align with the one or more second apertures when the enclosure body and cover are positioned in the channel.

* * * * *